US011999919B2

(12) United States Patent
Han et al.

(10) Patent No.: US 11,999,919 B2
(45) Date of Patent: Jun. 4, 2024

(54) NITROGEN-CONTAINING DIESEL SOLIDIFICATION POINT DEPRESSANT COMPOSITION, AND PREPARATION AND APPLICATION THEREOF

(71) Applicant: SHANGHAI INSTITUTE OF TECHNOLOGY, Shanghai (CN)

(72) Inventors: Sheng Han, Shanghai (CN); Hualin Lin, Shanghai (CN); Suya Yin, Shanghai (CN); Xin Li, Shanghai (CN); Mingxia Yuan, Shanghai (CN); Maiying Xie, Shanghai (CN); Fengfei Chen, Shanghai (CN); Taishun Yang, Shanghai (CN)

(73) Assignee: SHANGHAI INSTITUTE OF TECHNOLOGY, Shanghai (CN)

( * ) Notice: Subject to any disclaimer, the term of this patent is extended or adjusted under 35 U.S.C. 154(b) by 0 days.

(21) Appl. No.: 17/927,696

(22) PCT Filed: May 27, 2021

(86) PCT No.: PCT/CN2021/096307
§ 371 (c)(1),
(2) Date: Nov. 24, 2022

(87) PCT Pub. No.: WO2021/244385
PCT Pub. Date: Dec. 9, 2021

(65) Prior Publication Data

US 2023/0220292 A1 Jul. 13, 2023

(30) Foreign Application Priority Data

May 30, 2020 (CN) ..... 202010479884.9

(51) Int. Cl.

| | |
|---|---|
| ***C10L 10/14*** | (2006.01) |
| ***C10L 1/14*** | (2006.01) |
| *C10L 1/16* | (2006.01) |
| *C10L 1/198* | (2006.01) |
| *C10L 1/222* | (2006.01) |
| *C10L 1/224* | (2006.01) |

(52) U.S. Cl.
CPC ..... *C10L 10/14* (2013.01); *C10L 1/143* (2013.01); *C10L 1/1608* (2013.01); *C10L 1/1985* (2013.01); *C10L 1/222* (2013.01); *C10L 1/224* (2013.01)

(58) Field of Classification Search
CPC .... F03B 13/00; F03B 17/005; F05B 2220/32; F05B 2260/422; F05B 2270/301; Y02E 60/16; C10L 1/143; C10L 1/1608; C10L 1/1985; C10L 1/222; C10L 1/224; C10L 10/14; C10L 1/2225; C10L 1/2364; C10L 10/00; C10L 10/16; C10L 2200/0446; C10L 2290/34; C08F 220/1818; C08F 220/54; E03C 1/0404; E03C 1/084; E03C 2001/0415; Y10T 137/9464
See application file for complete search history.

(56) References Cited

U.S. PATENT DOCUMENTS 6,248,702 B1 6/2001 Coolbaugh et al.

FOREIGN PATENT DOCUMENTS

| | | | | | |
|---|---|---|---|---|---|
| CA | 2254646 | A1 | | 6/1999 | |
| CN | 104357101 | A | | 2/2015 | |
| CN | 105542063 | A | * | 5/2016 | ..... C08F 218/08 |
| CN | 105542063 | A | | 5/2016 | |
| CN | 109135846 | A | * | 1/2019 | |
| CN | 109135846 | A | | 1/2019 | |
| CN | 110144247 | A | * | 8/2019 | |
| CN | 110144247 | A | | 8/2019 | |
| CN | 111676074 | A | | 9/2020 | |

OTHER PUBLICATIONS

CN105542063A BIB translate (Year: 2016).*
CN105542063A Claims translate (Year: 2016).*
CN105542063A Description translate (Year: 2016).*
CN109135846A BIB translate (Year: 2019).*
CN109135846A Claims translate (Year: 2019).*
CN109135846A Description translate (Year: 2019).*
CN110144247A BIB translate (Year: 2019).*
CN110144247A Claims translate (Year: 2019).*
CN110144247A Description translate (Year: 2019).*
International Search Report in PCT/CN2021/096307, issued by ISA, dated Aug. 25, 2021.
Written Opinion of the International Search Report in PCT/CN2021/096307, issued by ISA, dated Aug. 25, 2021.
First official action based on priority 202010479884.9, issued on Oct. 11, 2021.

* cited by examiner

*Primary Examiner* — Ellen M McAvoy
*Assistant Examiner* — Chantel Graham
(74) *Attorney, Agent, or Firm* — Zhu Lehnhoff LLP

(57) ABSTRACT

The present invention relates to a nitrogen-containing diesel solidification point depressant composition, and preparation and application thereof. The nitrogen-containing diesel solidification point depressant composition includes the following components in percentage by weight: 10-40% of monoisopropanolamine; 10-40% of cyclohexane; 0-20% of polyethylene glycol; and 40-60% of N-tetradecyl methacrylamide-tetradecyl methacrylate. After the prepared diesel solidification point depressant composition is added to commercially available 0 #diesel, a solidification point and a cold filter plugging point of the diesel are respectively depressed by 21-25° C. and 9-13° C.

12 Claims, No Drawings

NITROGEN-CONTAINING DIESEL SOLIDIFICATION POINT DEPRESSANT COMPOSITION, AND PREPARATION AND APPLICATION THEREOF

TECHNICAL FIELD

The present invention belongs to the technical field of diesel solidification point depressants, and relates to a nitrogen-containing diesel solidification point depressant composition, and preparation and application thereof.

BACKGROUND

Diesel attracts a great attention because of its durability, high efficiency, cleanliness, storage security, etc. However, the low-temperature fluidity of diesel restricts its performance, so the demand for low-solidifying diesel, especially diesel with a low cold filter plugging point, is even more urgent. Compared with other processes, the process of adding a solidification point depressant to produce low-solidifying diesel can extend the distillation range of diesel and save sources, and meanwhile has the characteristics of flexible operation, low cost, quick effect, retention of a high hexadecane wax component, etc. Therefore, it is an effective method for increasing productivity of high-quality diesel. A diesel solidification point depressant, also known as a low-temperature fluidity improver, is an important fuel additive in the production of diesel, and can significantly improve the low-temperature fluidity of diesel and depress a solidification point and a cold filter plugging point when added in a small amount. However, the current commercially available diesel solidification point depressants have the problems of large addition amount, insufficient dispersibility, etc.

SUMMARY OF THE INVENTION

An objective of the present invention is to provide a nitrogen-containing diesel solidification point depressant composition, and preparation and application thereof, which has the advantages of good solubility in diesel, small usage amount, significant solidification point and cold filter plugging point depression effects, etc.

The objective of the present invention is achieved by the following technical solutions.

A first technical solution of the present invention provides a nitrogen-containing diesel solidification point depressant composition, which includes the following components in percentage by weight:

| | |
|---|---|
| monoisopropanolamine | 10-40%; |
| cyclohexane | 10-40%; |
| polyethylene glycol | 0-20%; and |
| N-tetradecyl methacrylamide-tetradecyl methacrylate | 40-60%. |

Further, the N-tetradecyl methacrylamide-tetradecyl methacrylate is prepared by reacting N-tetradecyl methacrylamide with tetradecyl methacrylate in toluene serving as a solvent in the presence of benzoyl peroxide serving as an initiator. More further, a molar ratio of the N-tetradecyl methacrylamide to the tetradecyl methacrylate is 1:10. More further, the reaction temperature is 120° C., and the reaction time is 8 h. According to the method, nitrogen-containing polar groups are introduced into a polymer, a certain proportion of cosolvent is added, and a solidification point depression effect of the polymer solidification point depressant is improved. Moreover, the experimental process is simple and easy to operate. N-tetradecyl methacrylamide provides long alkyl chains and has amide groups. Therefore, the N-tetradecyl methacrylamide-tetradecyl methacrylate polymer has abundant long chains and polar groups, and provides abundant crystallization sites, and the polar groups can delay the precipitation of wax crystals and repel the accumulation of wax crystals. Monoisopropanolamine, cyclohexane, and polyethylene glycol are selected as cosolvents and mixed with a solidification point depressant, and a trace amount of mixture is added to diesel to improve the sensitivity of the solidification point depressant to diesel.

Further, the solidification point depressant composition includes the following components in percentage by weight:

| | |
|---|---|
| monoisopropanolamine | 20-40%; |
| cyclohexane | 10-30%; |
| polyethylene glycol | 5-20%; and |
| N-tetradecyl methacrylamide-tetradecyl methacrylate | 40-60%. |

Further, the polyethylene glycol is polyethylene glycol 200.

A second technical solution of the present invention provides a preparation method of a nitrogen-containing diesel solidification point depressant composition, which includes the following steps: weighing stoichiometric N-tetradecyl methacrylamide-tetradecyl methacrylate, monoisopropanolamine, cyclohexane, and polyethylene glycol, stirring until uniform, and ultrasonically dispersing to yield a target product.

More further, the stirring temperature is 25-30° C., and the ultrasonic dispersion time is 10-20 min.

A third technical solution of the present invention provides application of a nitrogen-containing diesel solidification point depressant composition. When used, a nitrogen-containing diesel solidification point depressant composition is added to and mixed with diesel until uniform, and the mixture is ultrasonically dispersed.

Further, a mass ratio of the nitrogen-containing diesel solidification point depressant composition to the diesel is 1:(100-1000).

Further, the mixing temperature is 30-45° C., and the ultrasonic dispersion time is 30 min.

Further, the diesel is preferably commercially available 0 #diesel.

In the present invention, addition amounts of other additives and a polymer solidification point depressant are defined. In a case that the concentration of a component is reduced, the concentration of the solidification point depressant will be affected, and a solidification point depression effect will be reduced. An addition amount of N-tetradecyl methacrylamide-tetradecyl methacrylate is very important. In a case that a relatively small amount of solidification point depressant is added, there are not enough non-polar long-chain alkanes in a system to eutectic with normal alkanes in diesel, and there are not enough polar groups to keep the stability of wax crystals in the system. In a case that excessive solidification point depressant is added, the polymer will agglomerate to cause an adverse effect. Therefore, an appropriate amount of polymer can achieve the best solidification point depression effect.

Compared with the Prior Art, the Present Invention has the Following Advantages (1) The contained N-tetradecyl methacrylamide-tetradecyl methacrylate plays a major role in solidification point depression, accounts for a high proportion, changes a crystallization mode of diesel through eutectic reaction, adsorption, etc., and can effectively improve the low-temperature fluidity of diesel. The contained cyclohexane and polyethylene glycol (200) components are good solidification point depressant additives, which enable a solidification point depressant composition to be uniformly dispersed in diesel. Meanwhile, N-tetradecyl methacrylamide-tetradecyl methacrylate and monoisopropanolamine act synergistically to further enhance a solidification point depression effect.

(2) The solidification point depressant is ultrasonically dispersed in diesel by using an ultrasonic processor, so the preparation process is simple and convenient to operate, and has a significant effect.

(3) The dispersibility of a solidification point depressant in commercially available 0 #diesel is improved, and a solidification point and a cold filter plugging point of the diesel are respectively depressed by 21-25° C. and 9-13° C.

DETAILED DESCRIPTION OF THE PREFERRED EMBODIMENTS

The present invention will be described in detail below with reference to specific examples. The examples are implemented on the basis of the technical solutions of the present invention, detailed implementation modes and specific operation processes are given, but the scope of protection of the present invention is not limited to the following examples.

In the present invention, cold filter plugging points are determined in accordance with SH/T0248-2006 Diesel and Domestic Heating fuels—Determination of cold filter plugging point, and solidification points are determined in accordance with GB510-83 Petroleum Products—Determination of Solidification Point.

Raw materials used in the present invention:

| | |
|---|---|
| Sinopec 0# diesel | purchased from Shanghai Songjiang Petrol Station Company Limited; |
| monoisopropanolamine (analytically pure) | purchased from Titan Science Co., Ltd.; |
| cyclohexane (analytically pure) | purchased from Titan Science Co., Ltd.; |
| polyethylene glycol (200) (analytically pure) | purchased from Titan Science Co., Ltd.; |
| tetradecyl methacrylate | purchased from Titan Science Co., Ltd.; and |
| polymethacrylate solidification point depressant T1804 | purchased from Haiyan Fine Chemical Co., Ltd. |

N-tetradecyl methacrylamide is prepared by acylation, that is, an acid-binding agent and tetradecylamine are dissolved by stirring in N,N-dimethylformamide serving as a solvent, methacryloyl chloride is added to and reacts with the solution for 2 h, and the reaction product is washed with water and dried to yield N-tetradecyl methacrylamide. N-tetradecyl methacrylamide-tetradecyl methacrylate is prepared by reacting N-tetradecyl methacrylamide with tetradecyl methacrylate in a monomer molar ratio of 1:10 in toluene serving as a solvent in the presence of benzoyl peroxide serving as an initiator at 120° C. for 8 h.

Unless otherwise specified, other raw materials or processing techniques are conventional commercially available raw materials or conventional processing techniques in the art.

Example 1

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 10%; |
| cyclohexane | 20%; |
| polyethylene glycol (200) | 10%; and |
| N-tetradecyl methacrylamide-tetradecyl methacrylate | 60%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 1 were respectively depressed by 25° C. and 13° C.

Example 2

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 20%; |
| cyclohexane | 20%; |
| polyethylene glycol (200) | 5%; and |
| N-tetradecyl methacrylamide-tetradecyl methacrylate | 55%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 2 were respectively depressed by 24° C. and 12° C.

Example 3

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 30%; |
| cyclohexane | 10%; |
| polyethylene glycol (200) | 20%; and |
| N-tetradecyl methacrylamide-tetradecyl methacrylate | 40%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 3 were respectively depressed by 23° C. and 11° C.

Example 4

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 10%; |
| cyclohexane | 30%; |
| polyethylene glycol (200) | 10%; and |
| N-tetradecyl methacrylamide-tetradecyl methacrylate | 50%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 4 were respectively depressed by 22° C. and 10° C.

Example 5

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 20%; |
| cyclohexane | 30%; |
| polyethylene glycol (200) | 10%; and |
| N-tetradecyl methacrylamide-tetradecyl methacrylate | 40%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 5 were respectively depressed by 21° C. and 10° C.

Example 6

A diesel solidification point depressant composition that was prepared by mixing N-tetradecyl methacrylamide-tetradecyl methacrylate with monoisopropanolamine, cyclohexane, and polyethylene glycol (200) included the following components in percentage by mass:

| | |
|---|---|
| monoisopropanolamine | 20%; |
| cyclohexane | 20%; |
| polyethylene glycol (200) | 20%; and |
| N-tetradecyl methacrylamide-tetradecylmethacrylate | 40%. |

The above diesel solidification point depressant composition was applied to the depression of a solidification point of diesel, and a mass ratio of the diesel solidification point depressant composition to the diesel was preferably 1:200. The diesel solidification point depressant composition was added to 60 g of Songjiang 0 #diesel in a mass ratio of 0.1%, and the mixture was stirred at 50° C. until uniform and ultrasonically dispersed for 15 min to obtain diesel containing the diesel solidification point depressant composition.

By tests, a solidification point and a cold filter plugging point of the above commercially available 0 #diesel containing the above diesel solidification point depressant composition that was prepared in Example 5 were respectively depressed by 21° C. and 9° C.

Contrast 1

The N-tetradecyl methacrylamide-tetradecyl methacrylate solidification point depressant used in Example 1 was not mixed with monoisopropanolamine, cyclohexane, and polyethylene glycol (200), and directly added to 60 g of Songjiang 0 #diesel in a mass ratio of 0.1%, and the mixture was stirred at 50° C. until uniform and ultrasonically dispersed for 15 min. By tests, a solidification point and a cold filter plugging point of the Songjiang 0 #diesel added with the solidification point depressant were respectively depressed by 19° C. and 7° C.

By comparing the above examples with Contrast 1, it can be seen that the solubility and the dispersibility of the diesel solidification point depressant composition that was prepared by mixing N-tetradecyl methacrylamide-tetradecyl methacrylate with monoisopropanolamine, cyclohexane, and polyethylene glycol (200) in diesel are improved by the solvents, a solidification point depression effect of the solidification point depressant composition is improved by the synergistic action of the solidification point depressants, and the low-temperature fluidity of diesel is improved.

Contrast 2

A preferred commercially available polymethacrylate solidification point depressant T1804 was applied to the depression of a solidification point of diesel, and a mass ratio of the solidification point depressant to the diesel was preferably 1:200. The diesel solidification point depressant was added to 60 g of Songjiang 0 #diesel in a mass ratio of 0.1%, and the mixture was stirred at 50° C. until uniform and ultrasonically dispersed for 15 min to obtain diesel containing the diesel solidification point depressant.

By tests, a solidification point and a cold filter plugging point of the above commercially available 0 #diesel containing the above diesel solidification point depressant that was prepared in Contrast 2 were respectively depressed by 19° C. and 6° C.

By comparing the above examples with Application Example 2, it can be seen that the diesel solidification point depressant composition prepared by mixing N-tetradecyl methacrylamide-tetradecyl methacrylate with monoisopropanolamine, cyclohexane, and polyethylene glycol (200) has higher sensitivity to diesel, and achieves a better solidification point depression effect.

Contrast 3

This contrast was basically the same as Example 1, and a difference was that monoisopropanolamine was replaced with an equal mass of N-tetradecyl methacrylamide-tetradecyl methacrylate.

By tests, a solidification point and a cold filter plugging point of the above commercially available 0 #diesel containing the above diesel solidification point depressant composition that was prepared in Contrast 3 were respectively depressed by 20° C. and 9° C.

By comparing the above examples with Application Example 1, it can be seen that the diesel solidification point depressant composition prepared by mixing N-tetradecyl methacrylamide-tetradecyl methacrylate with monoisopropanolamine, cyclohexane, and polyethylene glycol (200) has higher sensitivity to diesel, and achieves a better solidification point depression effect.

Contrast 4

This contrast was basically the same as Example 1, and a difference was that polyethylene glycol was replaced with an equal mass of cyclohexane.

By tests, a solidification point and a cold filter plugging point of the above commercially available 0 #diesel containing the above diesel solidification point depressant composition that was prepared in Contrast 4 were respectively depressed by 19° C. and 8° C.

By comparing the above examples with Application Example 1, it can be seen that the diesel solidification point depressant composition prepared by mixing N-tetradecyl methacrylamide-tetradecyl methacrylate with monoisopropanolamine, cyclohexane, and polyethylene glycol (200) has higher sensitivity to diesel, and achieves a better solidification point depression effect.

Contrast 5

This contrast was basically the same as Example 1, and a difference was that cyclohexane was replaced with an equal mass of polyethylene glycol.

By tests, a solidification point and a cold filter plugging point of the above commercially available 0 #diesel containing the above diesel solidification point depressant composition that was prepared in Contrast 5 were respectively depressed by 20° C. and 7° C.

By comparing the above examples with Application Example 1, it can be seen that the diesel solidification point depressant composition prepared by mixing N-tetradecyl methacrylamide-tetradecyl methacrylate with monoisopropanolamine, cyclohexane, and polyethylene glycol (200) has higher sensitivity to diesel, and achieves a better solidification point depression effect.

The above description of the examples is for those of ordinary skill in the art to understand and implement the present invention. It is obvious that those skilled in the art may easily make various modifications to these examples, and apply the general principles described here to other examples without involving any creative effort. Therefore, the present invention is not limited to the above examples, and improvements and modifications made by those skilled in the art based on the disclosure of the present invention without departing from the scope of the present invention shall fall within the scope of protection of the present invention.

The invention claimed is:

1. A nitrogen-containing diesel solidification point depressant composition, characterized by comprising the following components in percentage by weight:

| | |
|---|---|
| monoisopropanolamine | 10-40%; |
| Cyclohexane | 10-40%; |
| polyethylene glycol | 0-20%; and |
| N-tetradecyl methacrylamide-tetradecyl methacrylate | 40-60%. |

2. A method of preparing the nitrogen-containing diesel solidification point depressant composition according to claim 1, comprising preparing the N-tetradecyl methacrylamide-tetradecyl methacrylate by reacting N-tetradecyl methacrylamide with tetradecyl methacrylate in toluene serving as a solvent in the presence of benzoyl peroxide serving as an initiator.

3. The method according to claim 2, characterized in that a molar ratio of the N-tetradecyl methacrylamide to the tetradecyl methacrylate is 1:10.

4. The method according to claim 2, characterized in that the reaction temperature is 120° C., and the reaction time is 8 h.

5. The nitrogen-containing diesel solidification point depressant composition according to claim 1, characterized by comprising the following components in percentage by weight:

| | |
|---|---|
| monoisopropanolamine | 20-40%; |
| cyclohexane | 10-30%; |
| polyethylene glycol | 5-20%; and |
| N-tetradecyl methacrylamide-tetradecyl methacrylate | 40-60%. |

6. A method of preparing the nitrogen-containing diesel solidification point depressant composition according to claim 5, characterized by comprising the following steps: weighing stoichiometric N-tetradecyl methacrylamide-tetradecyl methacrylate, monoisopropanolamine, cyclohexane, and polyethylene glycol, stirring until uniform, and ultrasonically dispersing to yield a target product.

7. The method according to claim 6, characterized in that the stirring temperature is 25-30° C., and the ultrasonic dispersion time is 10-20 min.

8. Application of the nitrogen-containing diesel solidification point depressant composition according to claim 5, characterized in that when used, the nitrogen-containing diesel solidification point depressant composition is added to and mixed with diesel until uniform, and the mixture is ultrasonically dispersed.

9. The application of the nitrogen-containing diesel solidification point depressant composition according to claim 8, characterized in that a mass ratio of the nitrogen-containing diesel solidification point depressant composition to the diesel is 1:(100-1000).

10. The application of the nitrogen-containing diesel solidification point depressant composition according to claim 8, characterized in that the mixing temperature is 30-45° C., and the ultrasonic dispersion time is 30 min.

11. Application of the nitrogen-containing diesel solidification point depressant composition according to claim 1, characterized in that when used, the nitrogen-containing diesel solidification point depressant composition is added to and mixed with diesel until uniform, and the mixture is ultrasonically dispersed.

12. A method of preparing the nitrogen-containing diesel solidification point depressant composition according to claim 1, characterized by comprising the following steps: weighing stoichiometric N-tetradecyl methacrylamide-tetradecyl methacrylate, monoisopropanolamine, cyclohexane, and polyethylene glycol, stirring until uniform, and ultrasonically dispersing to yield a target product.

* * * * *